US006003860A

United States Patent [19]

von Aesch et al.

[11] Patent Number: 6,003,860

[45] Date of Patent: Dec. 21, 1999

[54] APPARATUS FOR FORMING PARTIAL STACKS FROM PRINTED SHEETS STANDING ONE BEHIND THE OTHER

[75] Inventors: Erwin von Aesch, Oftringen; Remy Mäder, Rheinfelden, both of Switzerland

[73] Assignee: Grapha-Holding AG, Switzerland

[21] Appl. No.: 09/042,746

[22] Filed: Mar. 17, 1998

[30] Foreign Application Priority Data

Mar. 18, 1997 [CH] Switzerland ..... 0648/97

[51] Int. Cl.[6] ..... B65H 31/04

[52] U.S. Cl. ..... 271/214; 271/177; 271/214

[58] Field of Search ..... 414/789.5, 790.9; 271/177, 178, 181, 214, 215, 218, 216

[56] References Cited

U.S. PATENT DOCUMENTS

| | | | |
|---|---|---|---|
| 4,772,003 | 9/1988 | Nobuta et al. | 271/181 |
| 5,358,232 | 10/1994 | Arendes et al. | 271/181 |

FOREIGN PATENT DOCUMENTS

| | | | |
|---|---|---|---|
| 0 623 542 A1 | 11/1994 | European Pat. Off. . | |
| 59-36066 | 2/1984 | Japan | 271/181 |
| 607979 | 12/1978 | Switzerland | 271/214 |

*Primary Examiner*—H. Grant Skaggs

*Attorney, Agent, or Firm*—Venable; George H. Spencer; Robert Kinberg

[57] ABSTRACT

An apparatus for forming partial stacks by separation of a stack of printed sheets standing one behind the other includes an approximately horizontal stack guide having a feed end for receiving printed sheets fed in a direction perpendicular to the stack guide from a feeding apparatus and stacking the printed sheets on edge to form a stack in a horizontal direction. A separating device is arranged along the horizontal stack guide for forming the partial stacks. The separating device includes a guide arrangement disposed parallel to the horizontal direction of stack forming. First and second components of the separating device are seated one behind the other on the guide arrangement and are displaceable along the guide arrangement. The first and second components are jointly displaceable to the feed end of the stack guide and are controllable to be separable from one another in a stack separating position. Spreading elements are pivotally connected to the first and second components of the separating device. The spreading elements are displaceable jointly with the first and second components to the feed end of the stack guide. Support elements each associated with a respective one of the first and second components of the separating device are driven into the stack of printed sheets between the spreading elements for separating the spreading elements from one other between two printed sheets thereby keeping the two printed sheets apart from one another and forming the partial stacks of printed sheets.

20 Claims, 10 Drawing Sheets

APPARATUS FOR FORMING PARTIAL STACKS FROM PRINTED SHEETS STANDING ONE BEHIND THE OTHER

CROSS-REFERENCE TO RELATED APPLICATIONS

The right of priority is claimed with respect to Swiss Application No. 1997 0648/97 filed in Switzerland on Mar. 18, 1997, the disclosure of which is incorporated herein by reference.

BACKGROUND OF THE INVENTION

The invention relates to an apparatus for forming a partial stack through the separation of printed sheets, which partial stack extends perpendicularly with respect to the printed sheets standing one behind the other, which apparatus is connected downstream of a feeding apparatus conveying the printed sheets in a preferably imbricated formation approximately perpendicularly to the direction of stack forming and which is provided with an approximately horizontal stack guide along which a multi-component separating device is arranged, which is intended for forming the partial stacks and which can be powered, which components of the separating device, are each provided with spreading elements of a spreading apparatus keeping the printed sheets apart in proximity of the stack guide, which spreading elements plunge between two printed sheets which follow one another fold forward, of which spreading elements the spreading element that is leading in the direction of stack forming is associated with the rear end of a formed partial stack and the trailing spreading element is associated with the front end of a subsequent stack of printed sheets or partial stack, and with which spreading elements a support element of a support apparatus is associated which support element can be driven into the stack of printed sheets between the spreading elements keeping the printed sheets apart from one another.

An apparatus of the type described above is disclosed in European patent application EP-A-0 623 542.

A principal demand with respect to an apparatus of this type is the reliable and damage-free separation of the printed sheets between two partial stacks to be formed which are first transported and deposited for intermediate storage or which, immediately afterward, are separated again during further processing.

SUMMARY OF THE INVENTION

It is an object of the invention to provide an apparatus with which, in a simple manner, precise separating conditions between two printed sheets of a stack can be accomplished for forming partial stacks.

The above and other objects are achieved according to the invention by the provision of an apparatus for forming partial stacks by separation of a stack of printed sheets standing one behind the other, comprising: an approximately horizontal stack guide having a feed end for receiving printed sheets fed in a direction perpendicular to the stack guide from a feeding apparatus and stacking the printed sheets on edge to form a stack in a horizontal direction; a separating device arranged along the horizontal stack guide for forming the partial stacks, the separating device comprising: a guide arrangement disposed parallel to the horizontal direction of stack forming; first and second components seated one behind the other on the guide arrangement and being displaceable along the guide arrangement, the first and second components being jointly displaceable to the feed end of the stack guide and being controllable to be separable from one another in a stack separating position; spreading elements each pivotally connected to a respective one of the first and second components of the separating device, one of the spreading elements being a leading spreading element, with respect to the direction of stack forming, and another of the spreading elements being a trailing spreading element, the spreading elements keeping the printed sheets apart in proximity of the stack guide by projecting between two printed sheets which follow one another, the leading spreading element being associated with a rear end of a formed partial stack and the trailing spreading element being associated with a front end of a subsequent stack of printed sheets, the leading and trailing spreading elements being displaceable jointly with the first and second components to the feed end of the stack guide; and support elements each associated with a respective one of the first and second components of the separating device for being driven in the stack separating position into the stack of printed sheets between the spreading elements for separating the spreading elements from one other between two printed sheets thereby keeping the two printed sheets apart from one another and forming the partial stacks of printed sheets.

Thus, according to the invention the spreading elements of the separating device can be displaced in a joined manner to the feeding end of the stack guide by means of a mutual approach of the components of the separating device, which components are seated one behind the other on the guide arrangement that is parallel to the direction of stack forming. Further, the spreading elements can be separated from one another in the stack separating position between two printed sheets by means of the support elements which can be driven into the stack of printed sheets.

Thus, the functions necessary for forming partial stacks can be executed along the stack guide in defined relationships, so that clear sequential conditions can be generated.

Further objects, features and advantages of the invention will become apparent from the following detailed description of the invention when considered in conjunction with the accompanying drawings.

DETAILED DESCRIPTION OF THE INVENTION

Figure 1:
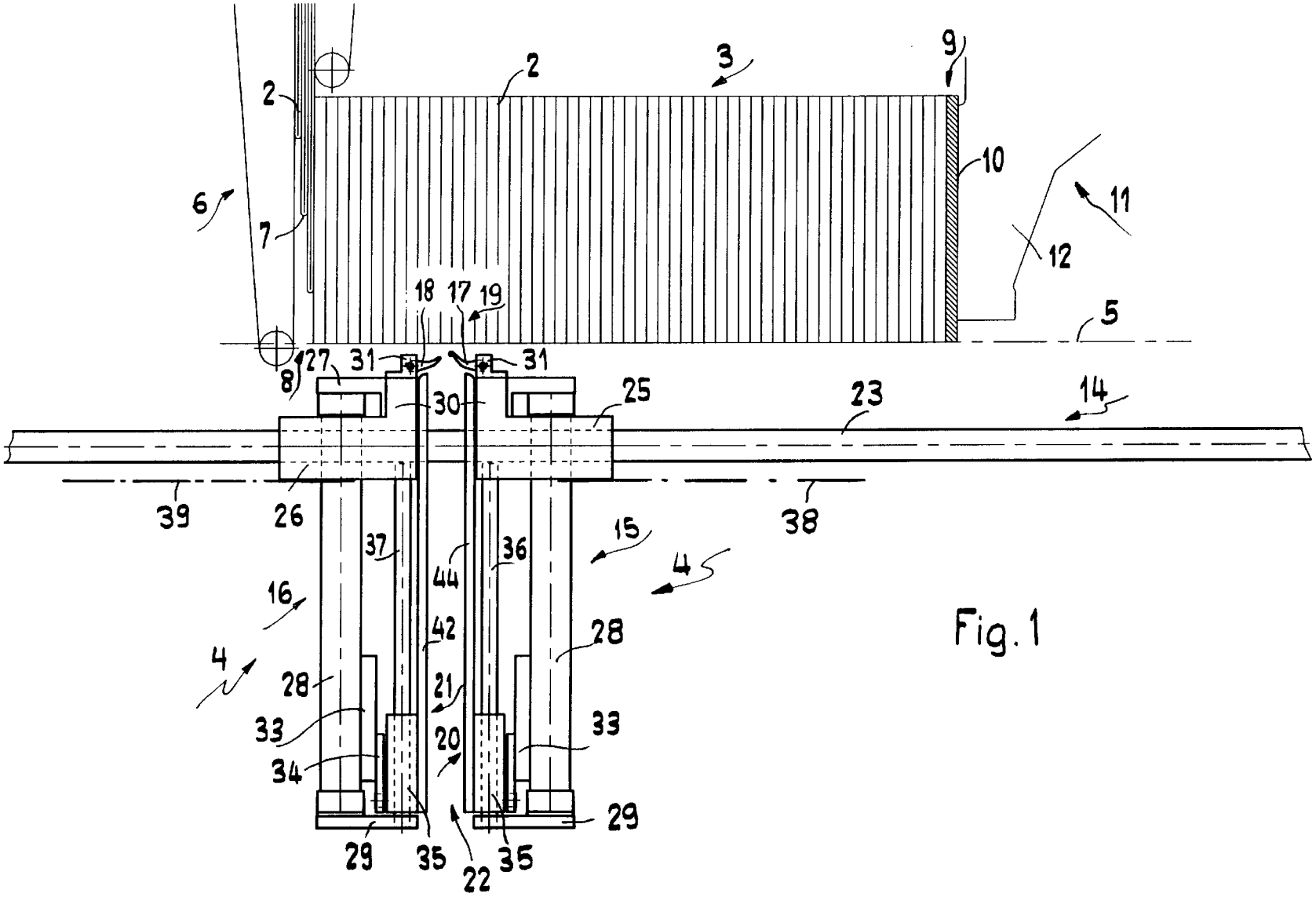
FIGS. 1 to 9 are schematics showing side elevations of the apparatus according to the invention in different working positions during the forming of partial stacks from printed sheets.

FIGS. 1 to 9 illustrate in sequence the production of a partial stack 1 from a stack 3 of printed sheets 2. FIG. 1 illustrates an initial position in which a two-part separating device 4 is disposed on a return path into an initial position. Printed sheets 2 stand on their fold 7 one behind the other on a stack guide 5, which is indicated here by a dash-dot line and which is formed by a pulling means 32 (shown in FIGS. 10 and 11), for example, endlessly circulating toothed belts, and stationary guide strips. The stack 3 of printed sheets is formed by a feeding apparatus 6. Printed sheets 2 arrive in an imbricated formation at a feeding end 8 of stack guide 5. Stack forming takes place from feeding end 8 toward the right.

A front end 9 of stack 3 of printed sheets 2 rests against an end plate 10, which delimits a front end of a later formed partial stack 1. End plate 10, in turn, rests against one of two clamping elements 12, 13 of a pressing apparatus 11 and is slidingly supported on stack guide 5.

The apparatus of the invention would also permit feeding of printed sheets from below to a stack guide arranged above the printed sheets.

Pressing apparatus 11 grasps a partial stack which has a predeterminable length and presses it together in a banding station (not shown) following the stack forming section or on the way to a banding station.

FIG. 1 additionally shows units 15, 16 of two-part separating device 4, which units are disposed on a guide arrangement 14 in the return travel mode along stack guide 5. For this purpose, each unit 15, 16 is comprised, respectively, of a spreading element 17 or 18 of a spreading apparatus 19, and a support element 20 or 21 of a support apparatus 22. Units 15 and 16 are disposed below stack guide 5.

Figure 11:
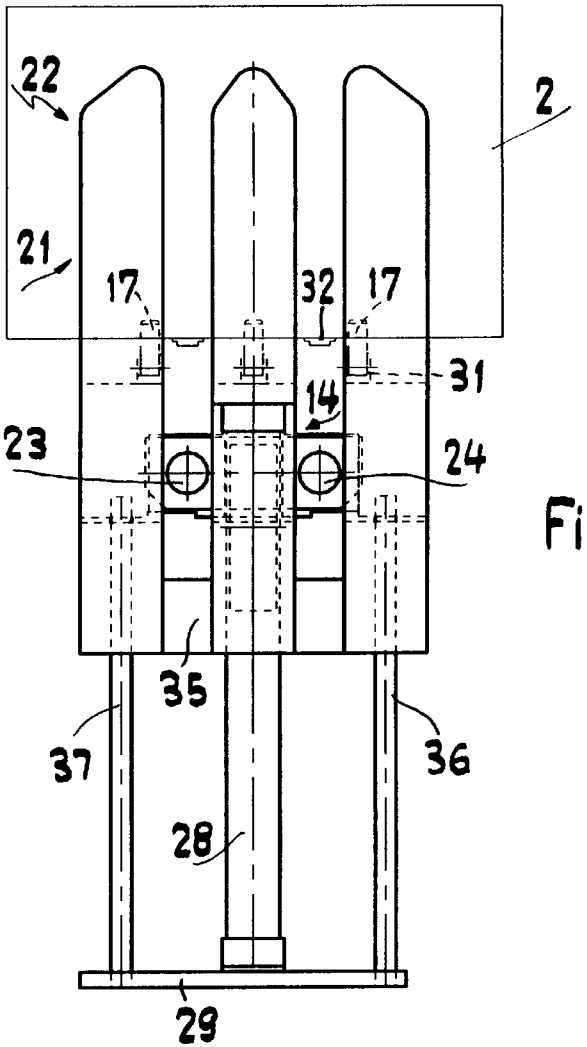
FIG. 11 is a section through the apparatus according to line XI—XI in FIG. 6.
Figure 10:
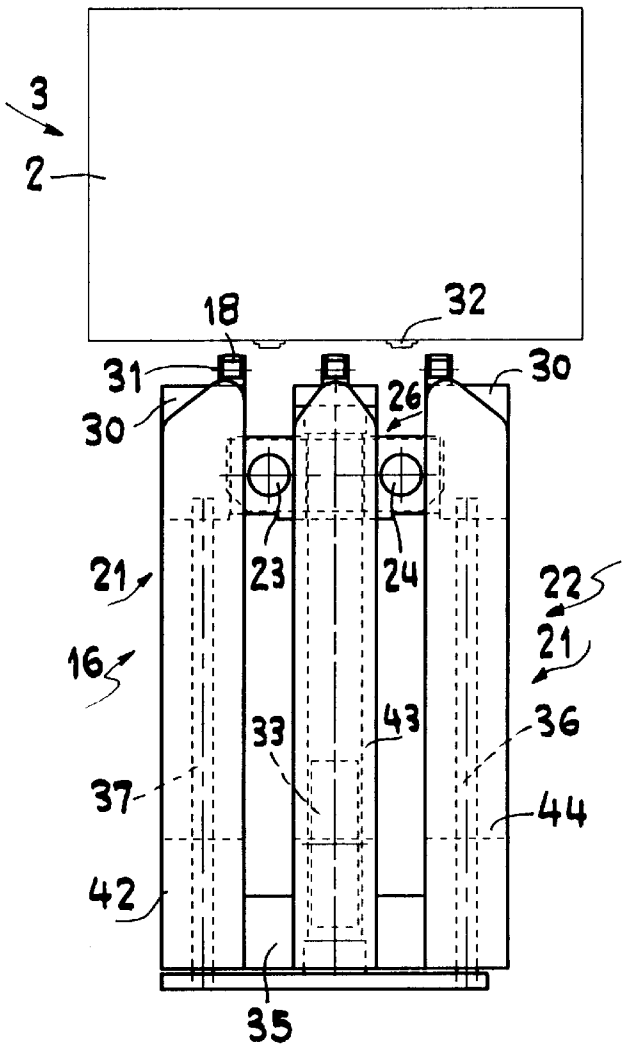
FIG. 10 is a section through the apparatus according to line X—X in FIG. 9.

Units 15, 16, additionally include carrier frames 25 and 26, respectively, which are slidably guided by way cylindrical liners (not shown) on parallel rails 23, 24 of guide arrangement 14 (see also FIGS. 10 and 11). Carrier frames 25 and 26 each include an extension arm 27. The two extension arms 27 of carrier frames 25 and 26 project with opposite orientation along the direction of movement of units 15, 16. A downwardly extending piston cylinder unit 28 is fastened to each extension arm 27. Each piston cylinder unit 28 is connected to a support 29 at a bottom end of the respective carrier frame. Carrier frames 25, 26 each have three hump-shaped structures 30, which are disposed transversely to the direction of movement and spaced apart from one another. Spreading elements 17, 18 are oriented toward one another and are arranged on structures in a bearing block 31 in which they are pivotably seated.

Spreading elements 17, 18 are charged with a restoring force, which is active in a downward direction or in a direction oriented away from the stack of printed sheets 3. The restoring force can be effected, for example, by a torsion spring (not shown) or through gravity. A stop (not shown) limits the pivot movement in the downward direction, so that spreading elements 17, 18 are kept in a non-active position during their return into the initial position at feeding end 8.

A catch 33, which is connected with the piston of the piston cylinder unit 28, is connected via an intermediate element 34 to a drive carrier 35 of a support element 20, 21 of support apparatus 22. Each support element 20, 21 includes three support plates distributed over the width of the drive carrier 35 and extending approximately to the spreading elements 17, 18. In the interest of a gentle advance movement, the ends of the support plates oriented toward stack guide 5 are configured to be wedge-shaped with respect to width and thickness. Drive carrier 35 of each support elements 20, 21 is guided on two spaced guide rods 36, 37 (See FIGS. 10 and 11) so as to be displaceable, with the ends of the guide rods being anchored in the support frame 25, 26 on the one hand and in the support 29 on the other.

Because of the relatively wide support surface, support plates 42 to 44 can carefully brush over printed sheets 2 that are effected by the advance movement.

During their return into the initial position, units 15, 16 have then again reduced the largest distance in the time domain of the end plate insertion.

Movement, both joint and independent, of controlled units 15, 16, is accomplished by toothed belts, 38, 39 which are shown schematically by dot-dash lines. Toothed belts 38, 39 are arranged to be laterally offset with respect to one another. They have an endless configuration and circulate around at least one driving roller (not shown).

Figure 2:
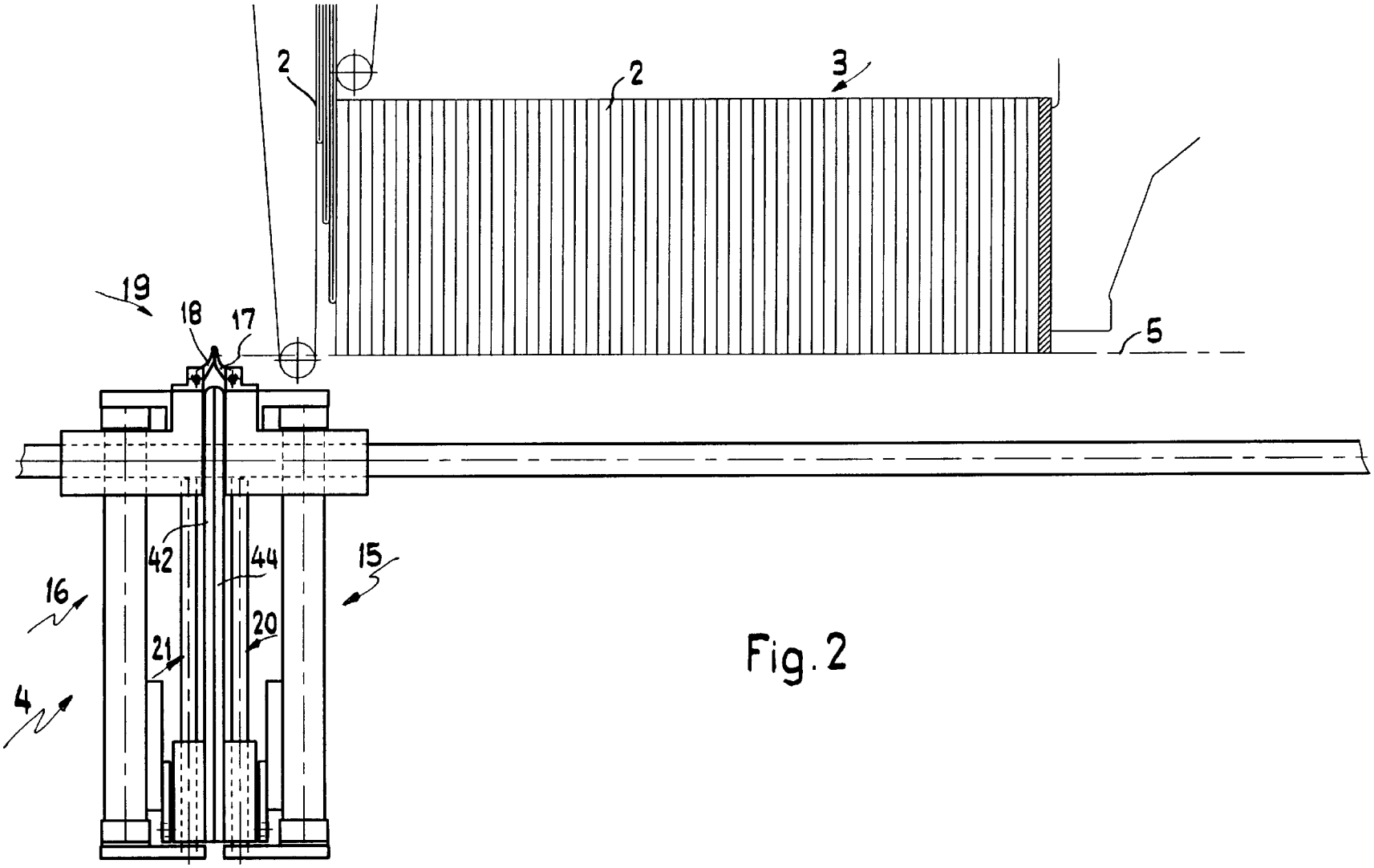

In FIG. 2, separating device 4 has reached its initial position, and units 15, 16 are brought together, with support elements 21, 22 comprised of support plates 42 to 44, being disposed opposite one another or are at least approximately resting against one another. Spreading elements 17, 18 are mutually joined during the approach of the units 15, 16 to form an element that is standing upright. Spreading element 17 facing the stack of printed sheets 3 has a nose-like end, which at least partially covers the upright standing end of the other spreading element 18 in order to prevent a stage that would hinder the feed flow. Printed sheets 2 which are conveyed toward stack guide 5 can slide along the spreading element 18 without interference, and both spreading elements have a shape which excludes any damage to printed sheets 2. Spreading elements 17, 18 each have a tooth, flank-like shape oriented toward one another, so that, as they set themselves upright, they can stand each other up or roll off on each other. In order to reduce wear, the relevant surfaces of the spreading elements 17, 18 can be hardened or coated.

The fact that the stack guide is permanently supplied with printed sheets, or that a stack is formed on a continuous basis, is illustrated by a comparison of the stack lengths in FIGS. 1 and 2 as well as by the further FIGS. 3 to 9.

In FIG. 2, support elements 20, 21 are in a resting position, but units 15, 16 are prepared for action.

Figure 3:
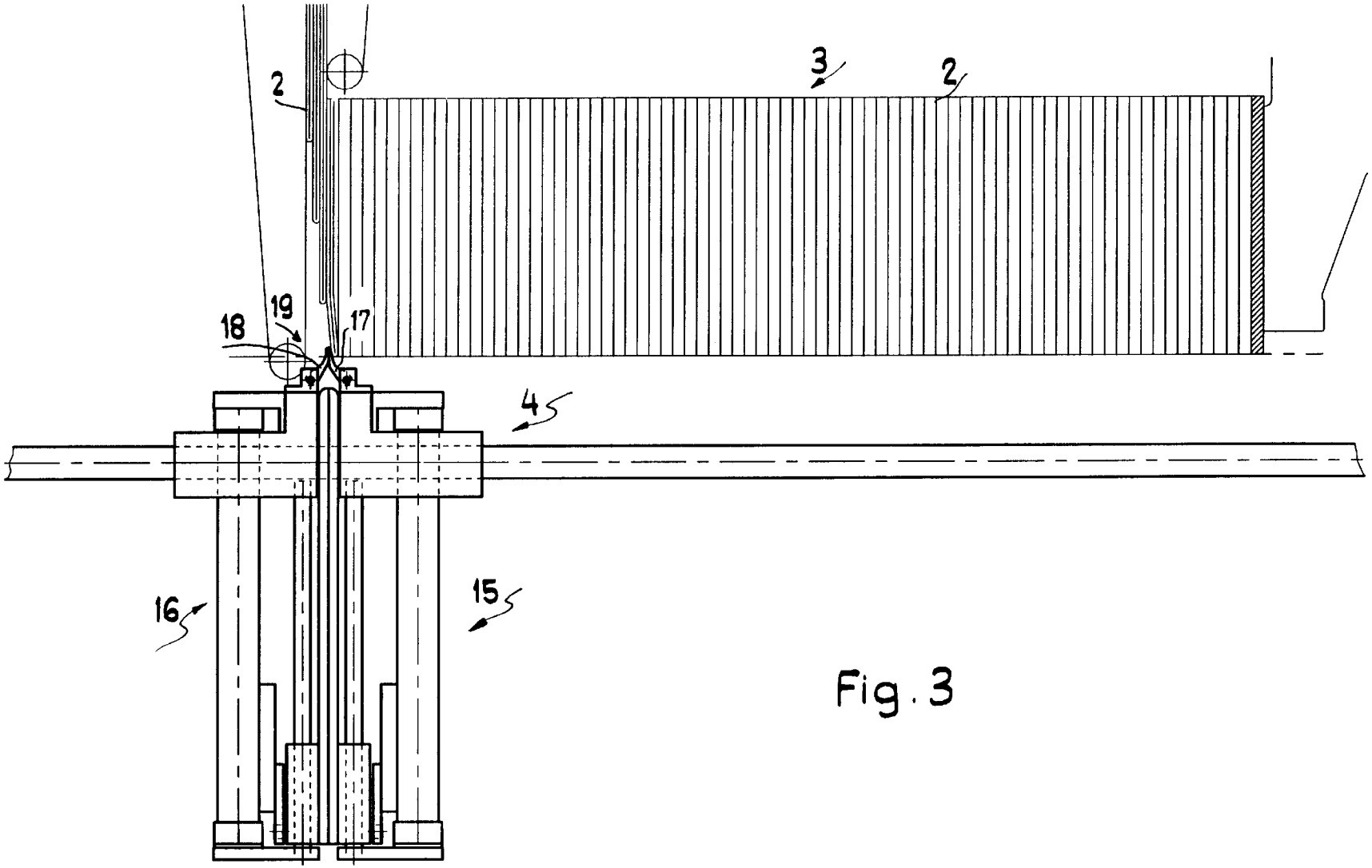

In FIG. 3, separating device 4 has been moved downstream into a dividing or separating position because a predetermined amount of stacked printed sheets 2 for a partial stack 1 has been reached. In this position, spreading apparatus 19 rests with spreading element 17 against the existing stack of printed sheets 3 before the next printed sheet 2 of the imbricated formation reaches stack guide 5 on the opposite side of the spreading apparatus 19. This means that, compared to FIG. 2, the position of separating device 4 on the guide arrangement 14 has changed.

Figure 4:
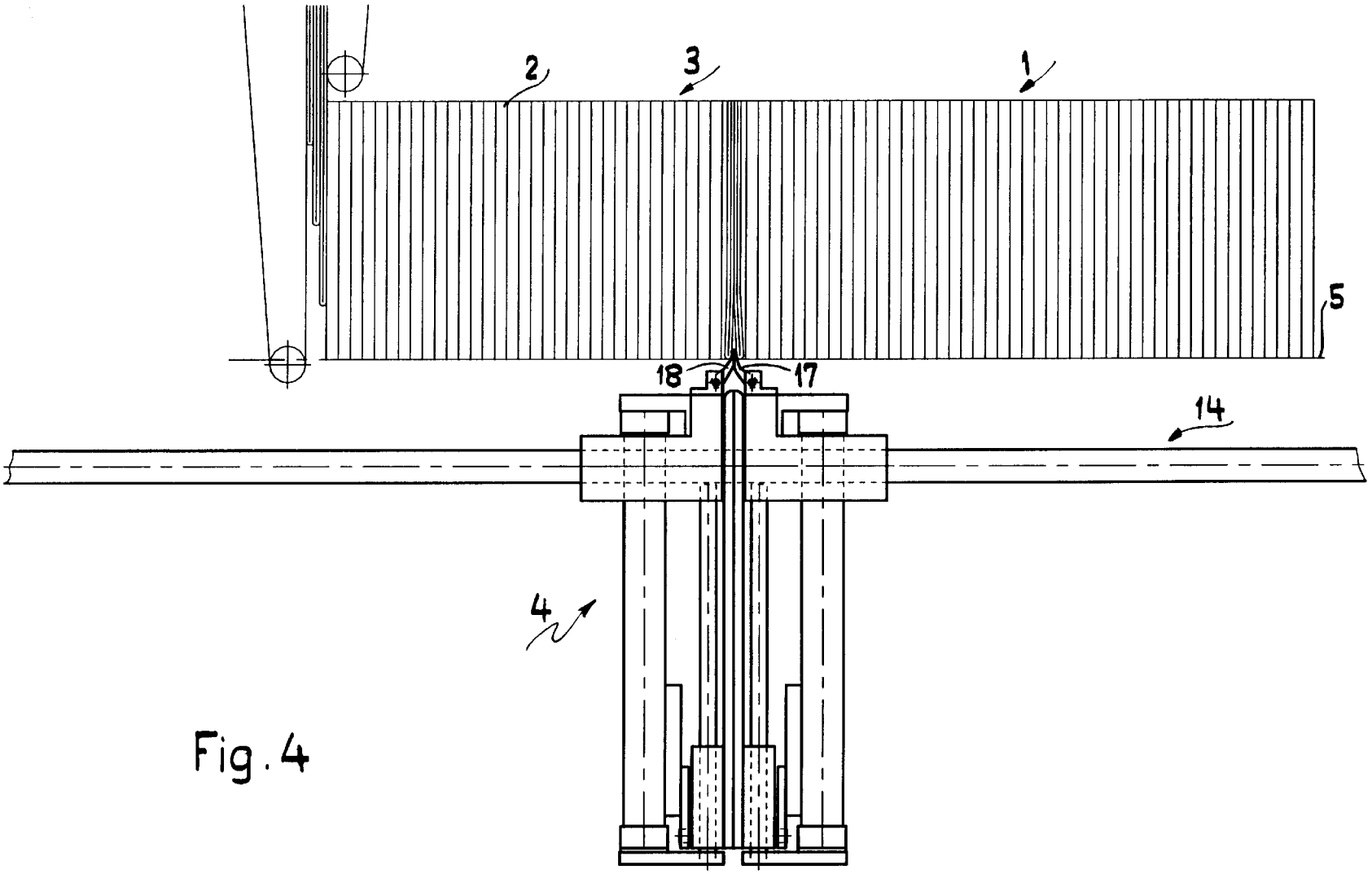

Afterward, with a movement of separating element 4 in the same direction of stack forming, a new stack 3 of printed sheets is formed opposite partial stack 1, on the rearward side of the spreading apparatus 19, as is illustrated in FIG. 4. There, separating device 4 is disposed between a partial stack 1, which will soon be displaced into a press arranged on stack guide 5, and a stack 3 of printed sheets on stack guide 5 which continues to get larger.

Figure 5:
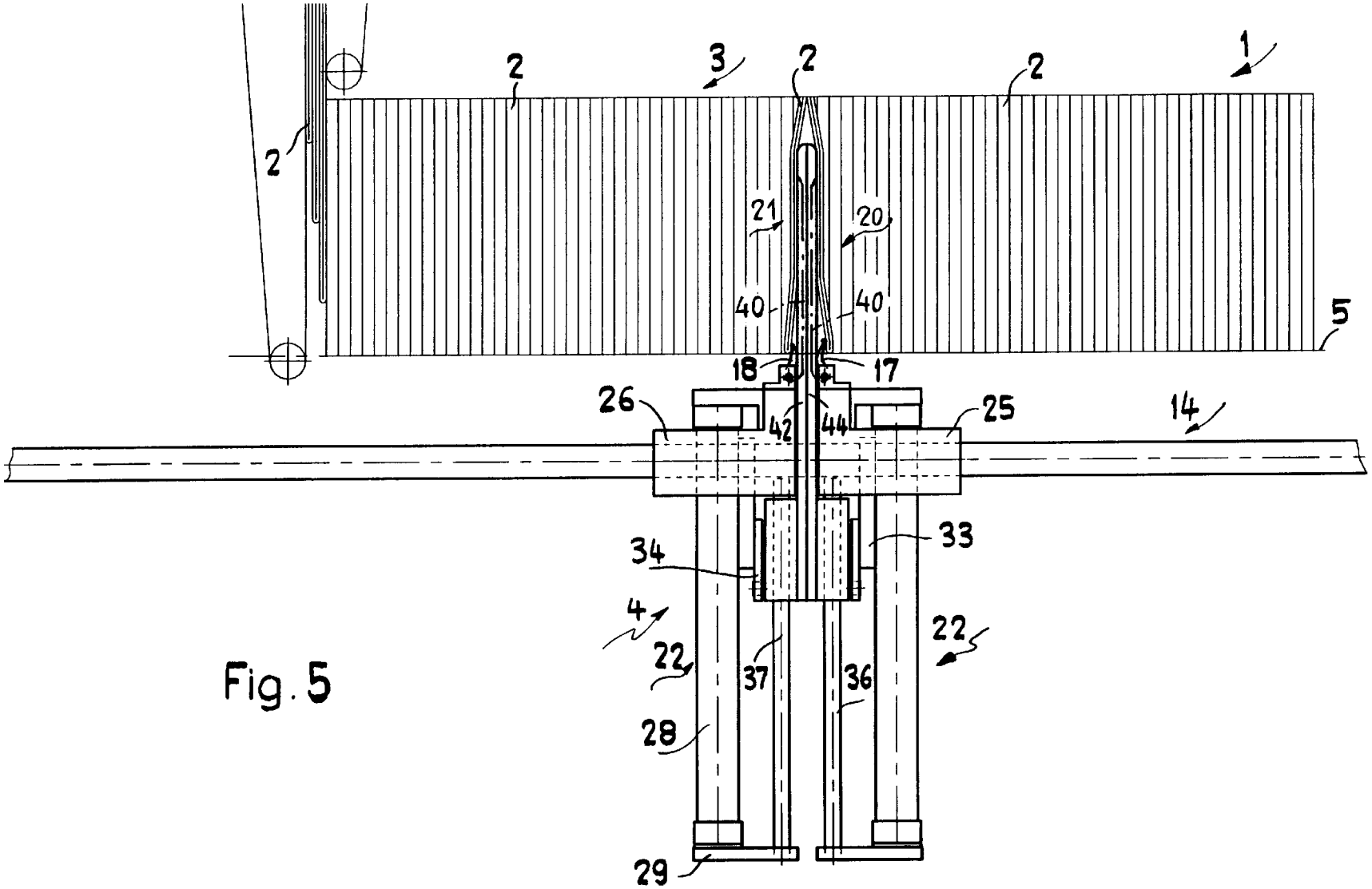

In FIG. 5, separating device 4 has reached the separating position on stack guide 5, which, among other things, is a function of the selected or predetermined length of a partial stack 1, that is, partial stacks 1 of different lengths can be created by means of the apparatus according to the invention.

First, support elements 20, 21 of support apparatus 22 are extended on separating device 4 which co-circulates so as to increase stack length. The upward movement of support elements 20, 21 separates spreading elements 17, 18 from one another, so that a distance between the end of leading partial stack 1 and the beginning of the subsequent stack 3 of printed sheets is generated.

Of course, matched to the joint motional sequence, spreading elements 17, 18 and support elements 20, 21 could also be displaced into a desired operating position through their own driving means. However, according to FIG. 5, this joint motional sequence, wherein spreading elements 17, 18 produce a greater penetration gap for subsequent support elements 20, 21, and their support plates 42 to 44, is effected through driven support elements 20, 21 acting on spreading elements 17, 18.

A control (not shown) initiates a lifting movement of pistons (also not shown) of piston cylinder units 28, which in turn lift, via catches 33, connecting elements 34 and drive carriers 35, support elements 20, 21. The rounded off edges of upwardly moving support plates 42–44, constituting support elements 20, 21, push aside spreading elements 17, 18. The upwardly moving support elements 20, 21 then plunge between printed sheets 2 resting against spreading elements 17, 18, enlarging the distance between the printed sheets.

In order to prevent damage to printed sheets 2 that rest against spreading elements 17, 18, a recess 40 is provided on support elements 20, 21 (indicated only in FIG. 5 with dash-dot lines) which makes it possible to at least partially receive spreading elements 17, 18, so that the frictional pressure on the surfaces of printed sheets 2 produced by the spreading elements can be reduced.

Figure 6:
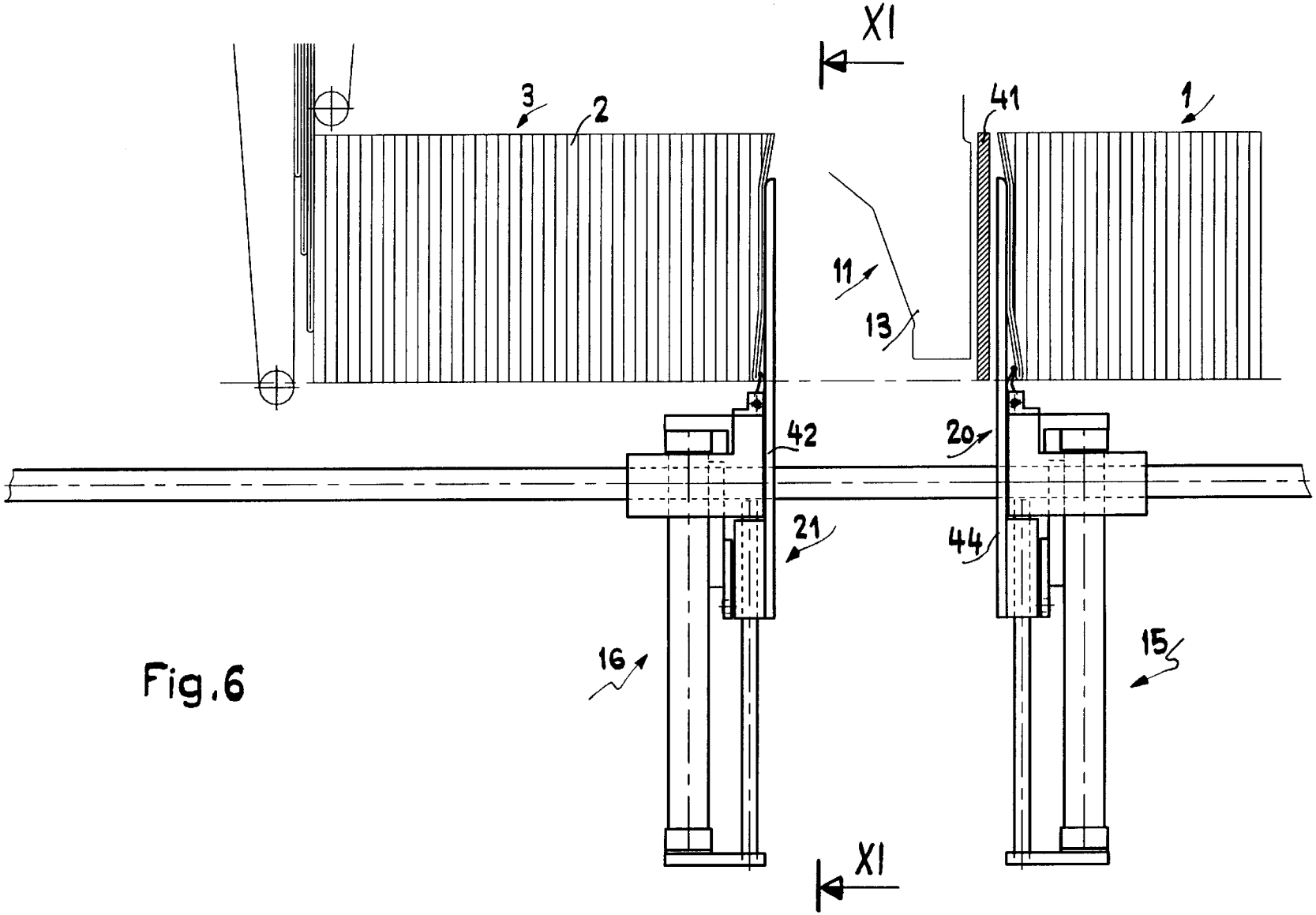

As the size of the stack 2 of printed sheets progresses, FIG. 6 shows the installation of an end plate 41 at the rear side of partial stack 1 which is moved away from the stack 3 of printed sheets 2 at a greater speed. In this position, unit 15 holds partial stack 1 together temporarily via supporting plates 42 to 44 until end plate 41 is inserted into a narrow gap formed between supporting plates 42 to 44 and clamping element 13. Stack forming on stack guide 5 continues without interruptions while all these operations and prior operations are performed.

Figure 7:
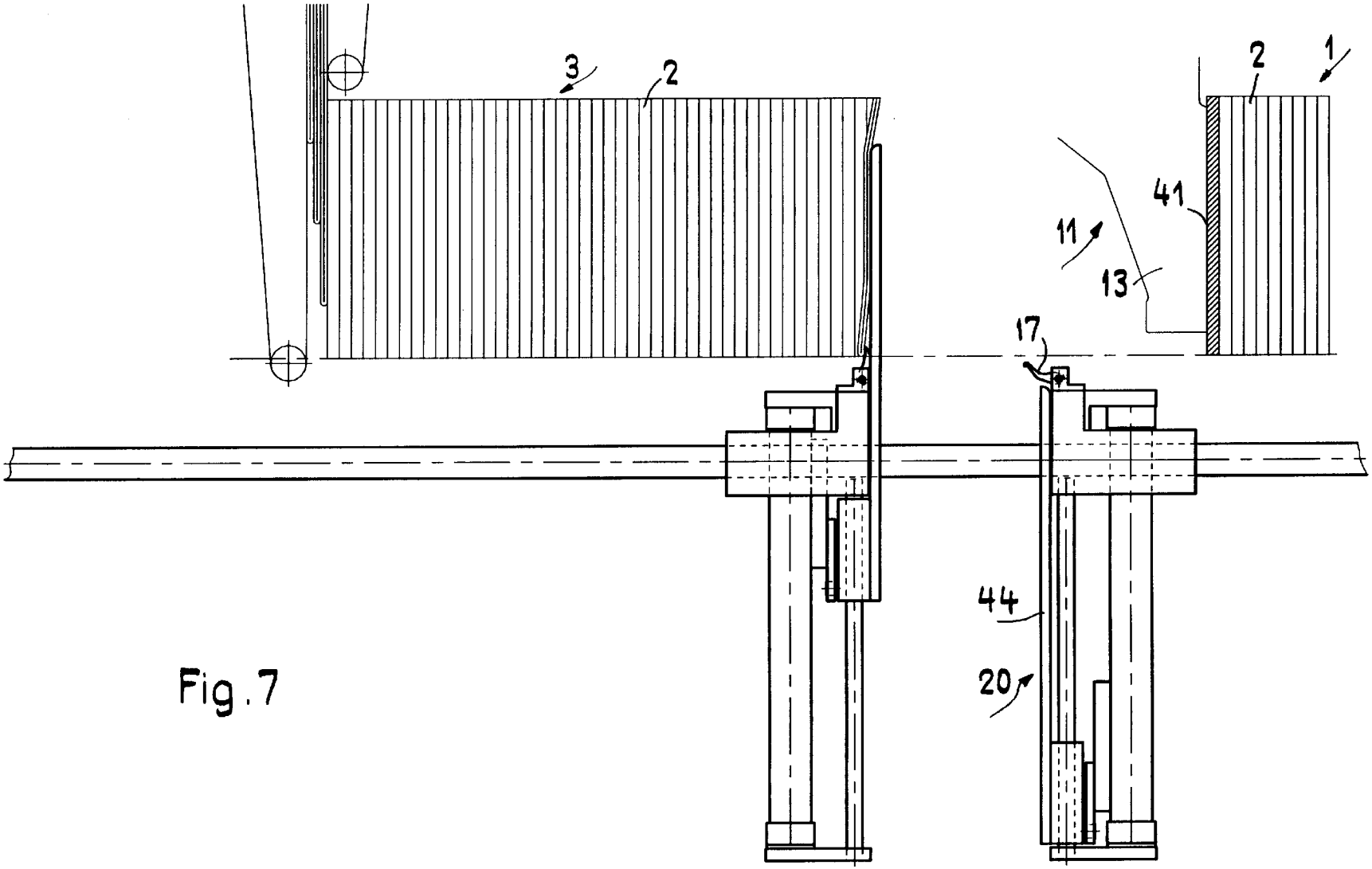

As shown in FIG. 7, support element 20 of unit 15 has meanwhile moved from the aforementioned gap into a resting position below stack guide 5 and spreading element 17 has also reached a resting position because of the returned support element 20 and the restoring force acting on spreading element 17.

Through compression of printed sheets 2 and through displacement, partial stack 1 is now moved into a connected press, controlled in an integrated manner, where partial stack 1 is tied or banded with straps and is ejected from the machine, as is described in European Patent Application EP-A-0 623 542.

Release of clamping element 12 of pressing apparatus 11 and a cohesive coordination of all functions of the apparatus according to the invention through a control is required in order to accomplish an efficient and continuous flow for the uninterrupted, rapid production of partial stacks 1 from printed sheets 2 that are supplied. As soon as a partial stack 1 has been compressed and tied with straps, clamping elements 12, 13 of pressing apparatus 11 are again available for the insertion of end plates 10, 41 at the stack ends. Partial stack 1 is ejected from the pressing apparatus in a lateral direction, for example, by a bearing surface that can be powered.

Figure 8:
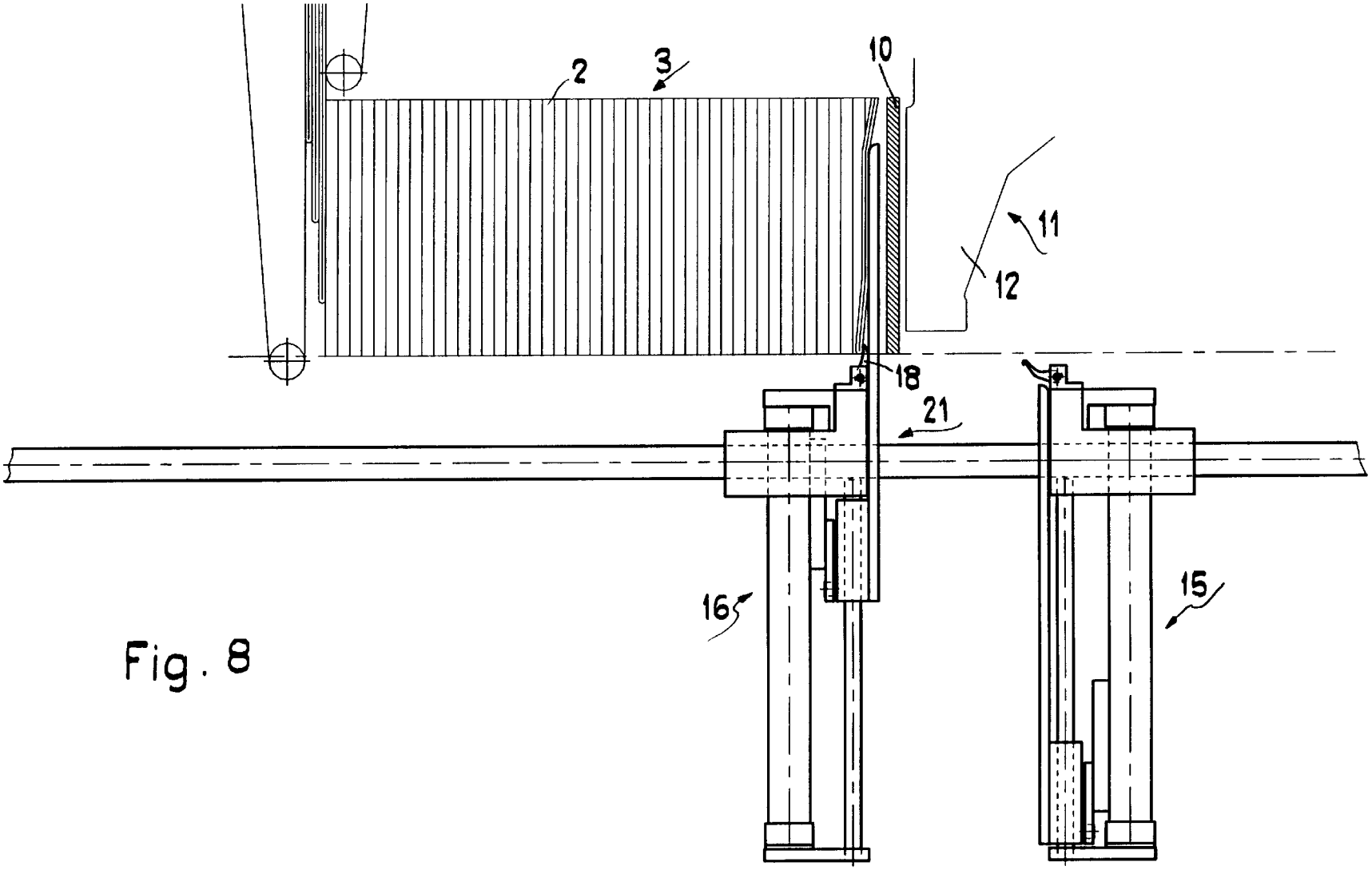

The next process step, namely to free unit 16 of the front end of stack 3 of printed sheets 2, takes place through insertion of an end plate 10 between support element 21 and returning clamping element 12 of pressing apparatus 11. This separating process is illustrated in FIGS. 8 and 9 and proceeds as described in the text regarding FIGS. 6 and 7.

Units 15 and 16 are then controlled to jointly leave the insertion position and return to the initial position as shown in in FIG. 2.

Figure 9:
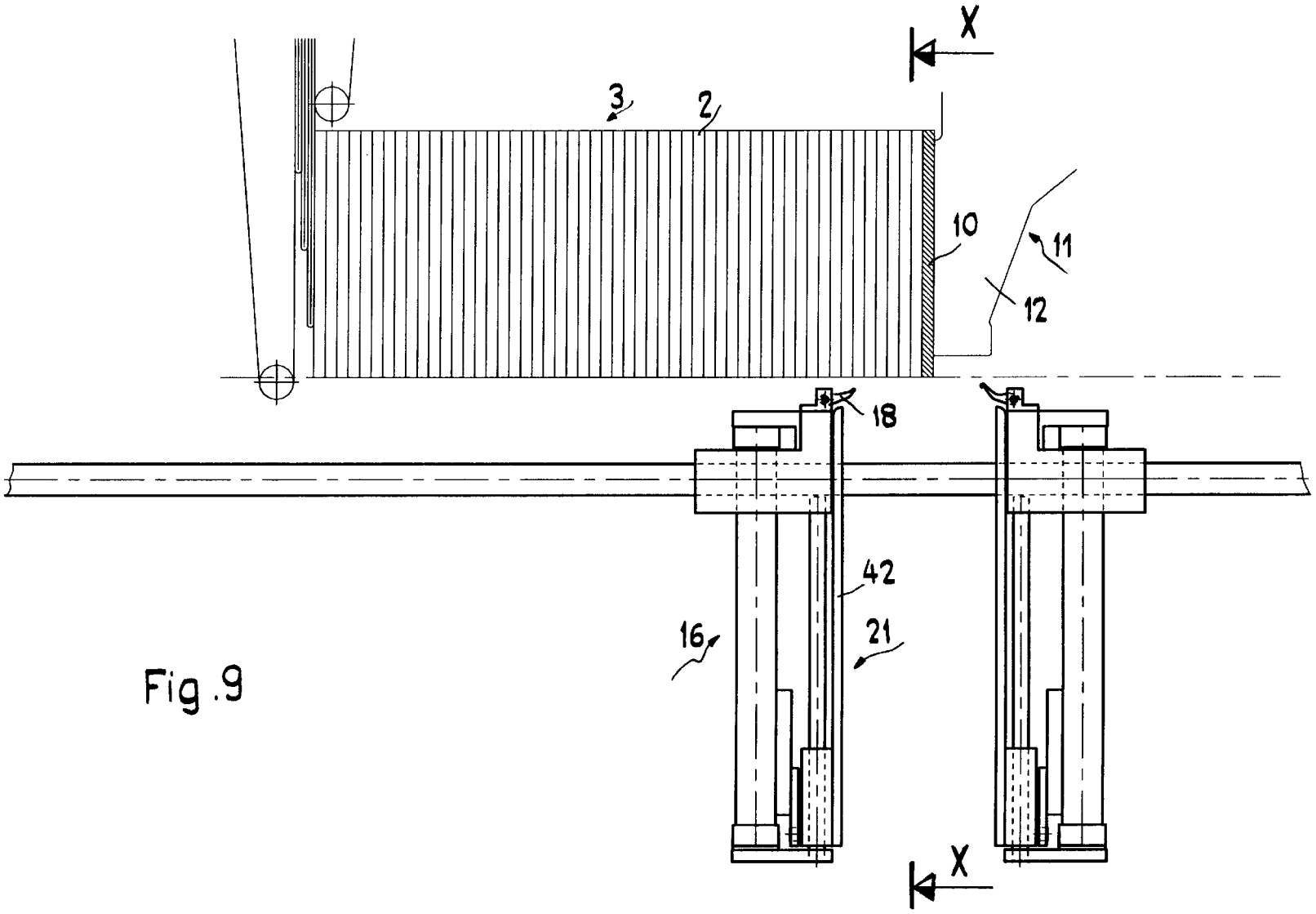

FIG. 10 shows unit 16 of separating device 4 immediately after end plate 10 has been added to the front end of stack 3 of printed sheets 2, where it is disposed in the return path to the initial position (see also FIG. 9).

FIG. 11 shows the extended position of unit 16 of separating device 4 with a view onto the front end of stack 3 of printed sheets 2 (see also FIG. 6), and pneumatic drive means which are controlled and connected to a pressure source.

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. An apparatus for forming partial stacks by separation of a stack of printed sheets standing one behind the other, comprising:

an approximately horizontal stack guide having a feed end for receiving printed sheets fed in a direction perpendicular to the stack guide from a feeding apparatus and stacking the printed sheets on edge to form a stack in a horizontal direction;

a separating device arranged along the horizontal stack guide for forming the partial stacks, the separating device comprising:

a guide arrangement disposed parallel to the horizontal direction of stack forming;

first and second components seated one behind the other on the guide arrangement and being displaceable along the guide arrangement, the first and second components being jointly displaceable to the feed end of the stack guide and being controllable to be separable from one another in a stack separating position;

spreading elements each pivotally connected to a respective one of the first and second components of the separating device, one of the spreading elements being a leading spreading element, with respect to the direction of stack forming, and another of the spreading elements being a trailing spreading element, the spreading elements keeping the printed sheets apart in proximity of the stack guide by projecting between two printed sheets which follow one another, the leading spreading element being associated with a rear end of a formed partial stack and the trailing spreading element being associated with a front end of a subsequent stack of printed sheets, the leading and trailing spreading elements being displaceable jointly with the first and second components to the feed end of the stack guide; and support elements each associated with a respective one of the first and second components of the separating device for being driven in the stack separating position into the stack of printed sheets between the spreading elements for separating the spreading elements from one other between two printed sheets thereby keeping the two printed sheets apart from one another and forming the partial stacks of printed sheets.

2. The apparatus according to claim 1, wherein the spreading elements are joined and separated against a restoring force.

3. The apparatus according to claim 1, wherein the spreading elements are pivotable around a horizontal axis oriented transversely to the stack guide.

4. The apparatus according to claim 3, wherein the spreading elements have free ends configured to be joined and engaging one another.

5. The apparatus according to claim 1, wherein the separating device includes units each composed of one of the first and second components of the spreading device, one of the separating elements and one of the support elements, and the units are driven one after the other along the stack guide.

6. The apparatus according to claim 5, wherein the first and second components of the separating device comprise respective carrier frames which are displaceable on the guide arrangement.

7. The apparatus according to claim 6, and further including a piston cylinder device fastened to each carrier frame of a respective one of the units and drive-connected to the support element of that unit.

8. The apparatus according to claim 5, and further including a pulling means connected to the units and powered for changing a working position of the units.

9. The apparatus according to claim 8, wherein the units are displaceable, in part, jointly into their working positions.

10. The apparatus according to claim 5, wherein the spreading element and the support element of each unit are adjustable, in part, jointly, with the corresponding elements of the other unit.

11. The apparatus according claim 5, wherein the spreading element of a unit is driven by a movement of the support element of the unit and by the unit itself.

12. The apparatus according to claims 5, wherein each unit includes a support and guide rods arranged between the support and the carrier frame, and the support elements are arranged on the guide rods for movement between the carrier frame and the support.

13. The apparatus according to claim 1, and further including drive means connected to the support elements for driving the support elements into the stack of printed sheets.

14. The apparatus according to claim 13, wherein the drive means is pneumatic and is drive-connected to a controlled pressure source.

15. The apparatus according to claim 13, and further including a control device connected to the controllable pressure source.

16. The apparatus according to claim 1, wherein the support elements each comprise several support plates arranged transversely to the direction of stack forming and have ends facing the stack of printed sheets that are drive-connected to the associated spreading element.

17. The apparatus according to claim 16, wherein the support plates have a side facing the spreading elements which include grooves parallel to a direction of movement of the support plates.

18. The apparatus according to claim 1, wherein the spreading elements are configured for raising into an operating position by a stand-up and roll-off movement oriented toward one another.

19. The apparatus according to claim 18, wherein the spreading elements have a curved lever shape.

20. The apparatus according to claims 1, and including a control device drive-connected to the separating device for displacing the separating device along the guide arrangement in a cadence of the printed sheet feed.

* * * * *